US010614951B2

(12) United States Patent
Nakahara et al.

(10) Patent No.: US 10,614,951 B2
(45) Date of Patent: Apr. 7, 2020

(54) WINDING UNIT

(71) Applicant: Yazaki Corporation, Tokyo (JP)

(72) Inventors: Takahiro Nakahara, Shizuoka (JP); Ngahu Antony Wambugu, Shizuoka (JP); You Yanagida, Shizuoka (JP); Masao Ishizaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 358 days.

(21) Appl. No.: 15/422,954

(22) Filed: Feb. 2, 2017

(65) Prior Publication Data

US 2017/0243694 A1 Aug. 24, 2017

(30) Foreign Application Priority Data

Feb. 4, 2016 (JP) ..... 2016-019585

(51) Int. Cl.
*H01F 27/28* (2006.01)
*H01F 38/14* (2006.01)
*H01F 27/00* (2006.01)

(52) U.S. Cl.
CPC ..... *H01F 38/14* (2013.01); *H01F 27/006* (2013.01); *H01F 27/2823* (2013.01); *H01F 27/2871* (2013.01)

(58) Field of Classification Search
USPC ..... 336/222, 220, 200, 232, 182, 188
See application file for complete search history.

(56) References Cited

U.S. PATENT DOCUMENTS

| | | | | |
|---|---|---|---|---|
| 9,073,442 | B2 | 7/2015 | Ichikawa | |
| 9,209,627 | B2 | 12/2015 | Baarman et al. | |
| 9,981,566 | B2 | 5/2018 | Ichikawa | |
| 2011/0156523 | A1* | 6/2011 | Kljaic | H02K 3/18 310/208 |
| 2013/0038278 | A1* | 2/2013 | Park | H02J 7/00 320/108 |

(Continued)

FOREIGN PATENT DOCUMENTS

| | | |
|---|---|---|
| JP | 2011-193671 A | 9/2011 |
| JP | 2013-080785 A | 5/2013 |

(Continued)

OTHER PUBLICATIONS

Chinese Office Action for the related Chinese Patent Application No. 201710067390.8 dated Mar. 5, 2018.

(Continued)

*Primary Examiner* — Elvin G Enad
*Assistant Examiner* — Kazi S Hossain
(74) *Attorney, Agent, or Firm* — Kenealy Vaidya LLP

(57) ABSTRACT

A winding unit including a case is provided. The case has a receiving space capable of housing at least one turn of a coil portion in addition to a winding portion in a radial direction. In case, a blank portion having a dimension of one turn of the coil portion in the radial direction is formed between the two coil portions next to each other in the winding portion. When manufacturing the winding unit, the blank portion can be formed in a suitable position, and the number of turns of the winding portion (the number of coil portion) does not need to change. Further, an inductance value of the winding portion can be adjusted with simply structure.

17 Claims, 7 Drawing Sheets

(56) References Cited

U.S. PATENT DOCUMENTS

| | | | | |
|---|---|---|---|---|
| 2014/0197694 | A1* | 7/2014 | Asanuma | H01F 38/14 307/104 |
| 2014/0339908 | A1* | 11/2014 | Omae | H01F 38/14 307/104 |
| 2017/0076854 | A1 | 3/2017 | Tokura et al. | |
| 2017/0103850 | A1 | 4/2017 | Furiya et al. | |

FOREIGN PATENT DOCUMENTS

| | | | |
|---|---|---|---|
| JP | 2013-541832 | A | 11/2013 |
| JP | 2014-043115 | A | 3/2014 |
| JP | 2014-160702 | A | 9/2014 |
| JP | 2015-222751 | A | 12/2015 |
| WO | 2015/199151 | A1 | 12/2015 |

OTHER PUBLICATIONS

Japanese Office Action for the related Japanese Patent Application No. 2016-019585 dated Jun. 5, 2018.

* cited by examiner

WINDING UNIT

BACKGROUND OF THE INVENTION

Field of the Invention

The present invention relates to a winding unit arranged on a power supplying unit or a power receiving unit of a non-contact power supply device.

Description of the Related Art

In general, as a non-contact power supply device, that of a resonant type has been known. In the resonant type non-contact power supply device, a variable capacitor is used to adjust the resonance frequency.

However, when using a large capacity capacitor, it is difficult to manufacture a variable capacitor. For this reason, it would be desired to omit the variable capacitor. Therefore, a structure having a mechanism for adjusting a number of turns of coil in the non-contact power supply device is provided (for example, see Patent Literature 1). In the coil of the non-contact power supply device described in Patent Literature 1, a member is used to change the winding shape of an end portion, or a part of coil is rewound so as to adjust the number of turns of coil. Therefore, a resonance frequency is adjusted by changing an inductance value of coil without changing a capacity of the capacitor.

Patent Literature 1: JP 2014-160702 A

SUMMARY OF THE INVENTION

However, in the coil for the non-contact power supply device described in the Patent Literature 1, structure is complicated so as to adjust the number of turns as mentioned above. Further, when the number of turns varies, the transformation ratio between a power transmission side and a power reception side is also changed. As a result, it is also considered that a voltage applied to a component (for example, secondary battery) is changed. Furthermore, when a power reception side unit of the non-contact power supply device is mounted on a vehicle, it is necessary to set an inductance value of the coil according to type or shape (vehicle height, mounting position and the like) of the vehicle in order to obtain a desired power transmission characteristic. In this case, when providing a special winding unit for each model, cost is increased. For this reason, in order to make parts common, the winding unit capable of adjusting the inductance value has been desired.

It is an object of the present invention to provide a winding unit which has a simple structure without changing a number of turns of a winding portion and can control an inductance value.

To solve the above issue and achieve the object, the present invention according to a first aspect is a winding unit including: a winding portion for transmitting/receiving power to be constructed by a plurality of turns of coil portion arranged in a predetermined arrangement direction; and a receiving portion having a receiving space capable of housing at least one turn of the coil portion in addition to the winding portion in the arrangement direction. A blank portion is formed between the two coil portions next to each other in the winding portion or between the coil portion positioned on an end portion in the arrangement direction in the winding portion and the receiving portion, the blank portion having a gap with a dimension of at least one turn of the coil portion in the arrangement direction.

The present invention according to a second aspect is the present invention according to the first aspect, wherein a movement restriction portion is provided in the receiving portion to restrict a movement of the coil portion constructing the winding portion to the blank portion.

The present invention according to a third aspect is the present invention according to the second aspect, wherein the movement restriction portion includes a holding groove placed on the coil portion and a projection formed between the holding grooves.

The present invention according to a fourth aspect is the present invention according to any one of the first to third aspects, wherein the winding portion is formed such that the coil portion is aligned in a radial direction as the arrangement direction, the receiving portion includes an inner wall portion along an inner side of the winding portion in the radial direction, and a part arrangement portion surrounded by the inner wall and be capable of placing a circuit component connected to the winding portion, and an inner wall passing section through which an electric wire for connecting the winding portion and the circuit component passes is formed in the inner wall portion.

The present invention according to a fifth aspect is the present invention according to any one of the first to fourth aspects, wherein the winding portion is formed such that the coil portion is aligned in a radial direction as the arrangement direction, the receiving portion has an outer wall portion along an outer side of the winding portion in the radial direction, and an outer wall passing section through which an electric wire for connecting the winding portion and external component passes is formed in the outer wall portion.

The present invention according to a sixth aspect is the present invention according to any one of the first to fifth aspects, wherein the winding portion is formed such that the coil portion is aligned in a radial direction as the arrangement direction, and the receiving portion has a bottom plate portion on which the winding portion is placed, and a standing wall standing from the bottom plate portion and located on the blank portion.

According to the present invention of the first aspect, since the receiving portion has the receiving space capable of housing at least one turn of the coil portion in addition to the winding portion, the blank portion can be formed at an appropriate position when manufacturing the winding unit. Further, by adjusting the position of the blank portion in which the coil portion is not provided, a mode of passage of the magnetic flux generated by passing a current through the winding portion is changed, and the inductance value of the winding portion is changed. At this time, it is not necessary to change the number of turns of the winding portion 2 (the number of coil portion), and the inductance value of the winding portion 2 can be adjusted with simply construction.

The winding portion of such winding unit may be manufactured by for example the following procedure. First, the relationship between the position of the blank portion and the inductance value of the winding portion is experimentally found. Next, the design value of the resonance frequency of the non-contact power supply device is determined, and the inductance value of the winding portion which is required for the response frequency to be the above design value is obtained. The blank portion is positioned in the position having the above inductance value, and the winding portion is formed thereto. Also, the blank portion may be simple space, or may be filled on a member other than the coil portion.

According to the present invention of the second aspect, the movement of the coil portion to the blank portion after manufacturing the winding unit and unintentionally changes of the inductance value of the winding portion can be prevented.

According to the present invention of the third aspect, since the coil portion is placed on the holding groove, the movement of the coil portion to the blank portion can be easily restricted by the projection.

According to the present invention of the fourth aspect, it is not necessary to change the number of turn of the winding portion so as to adjust the inductance value as described above. Therefore, a position putting out the electric wire from the winding portion inward in the radial direction can be maintained constant, and the electric wire can easily pass through the inner wall insertion hole 321. Furthermore, there is no need to change the orientation and arrangement of the capacitor 12 according to the number of turns.

According to the present invention of the fifth aspect, it is not necessary to change the number of turn of the winding portion so as to adjust the inductance value as described above. Therefore, a position putting out the electric wire from the winding portion outward in the radial direction can be maintained constant, and the electric wire can be easily passed through the outer wall passing section.

According to the present invention of the sixth aspect, since the standing wall is stood from the bottom plate portion, the strength of the receiving space can be improved. In other words, deformation such that the bottom plate portion is bent or twisted hardly occurs even if an external force is applied to the receiving space. Furthermore, since the standing wall is provided on the blank portion, it is possible to suppress increase in the overall size of the winding unit due to providing the standing wall. Also, the standing wall may be integrally formed together with the bottom plate portion, and the standing wall may be formed separately from the bottom plate portion. Moreover, the standing wall is arranged around the entire circumference of the blank portion, and a plurality of the standing walls spaced apart in the radial direction may be provided.

DESCRIPTION OF THE PREFERRED EMBODIMENT

Figure 1:
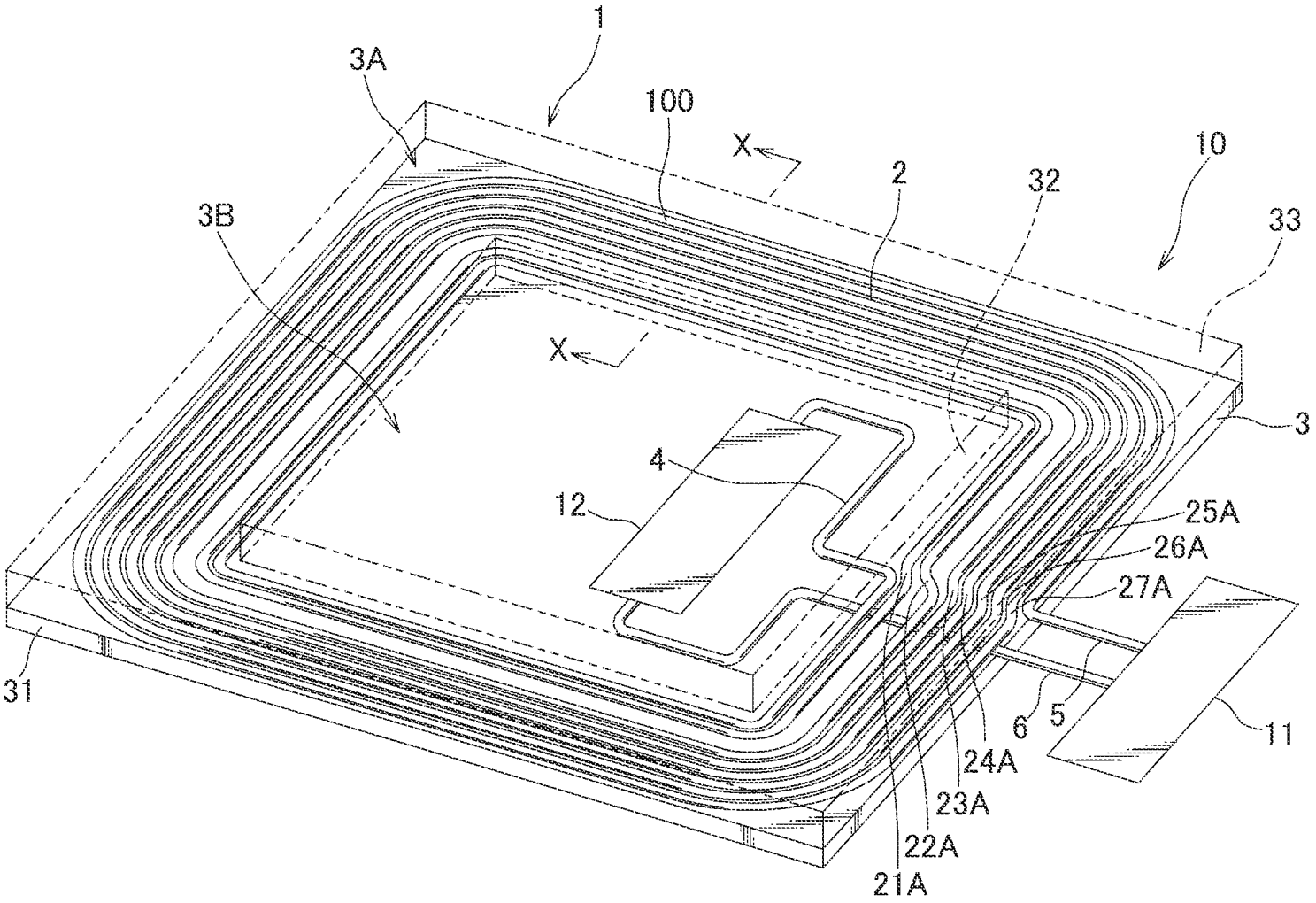
FIG. 1 is a perspective view showing a power supplying unit in which a winding unit according to an embodiment of the present invention is arranged.
Figure 2A:
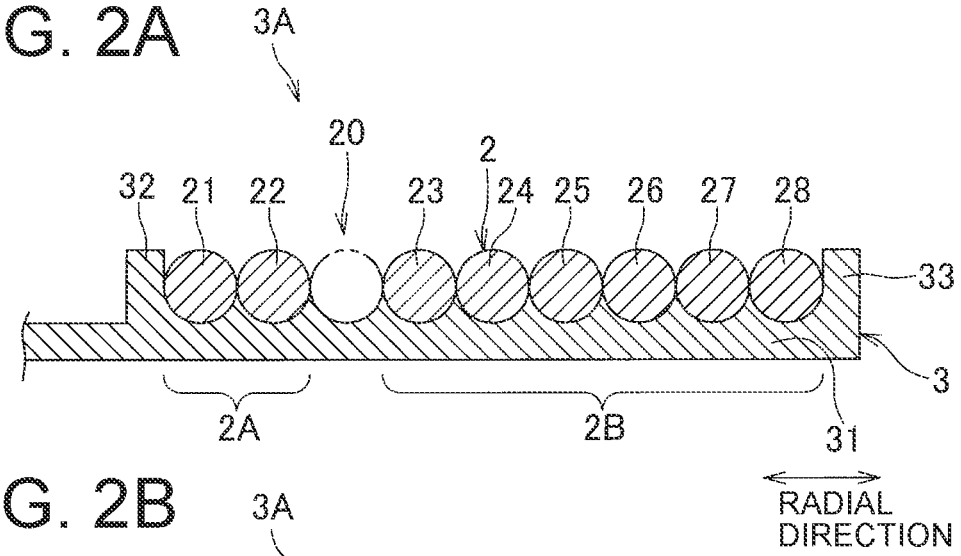
FIG. 2A is a cross sectional view taken along a X-X line of FIG. 1.
Figure 2B:
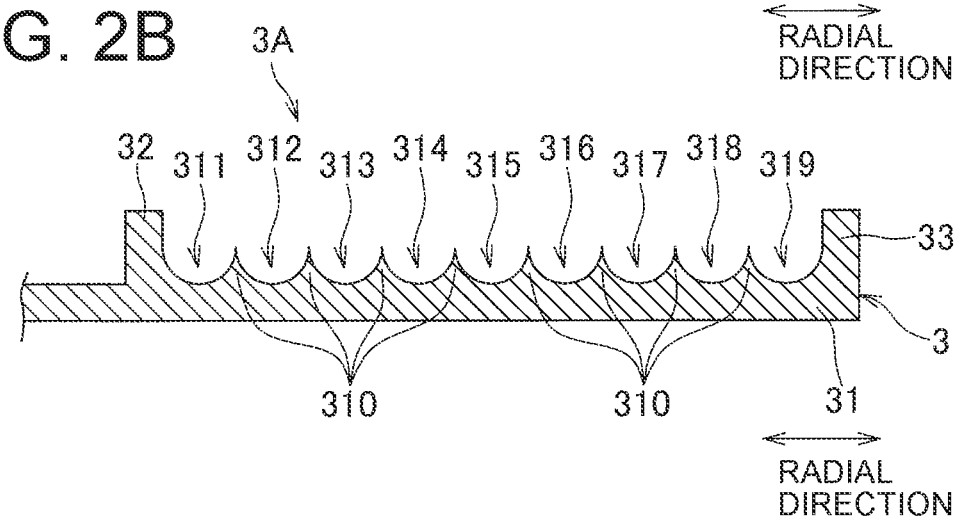
FIG. 2B is a cross sectional view showing a state that a winding portion is not arranged in FIG. 2A.
Figure 3:
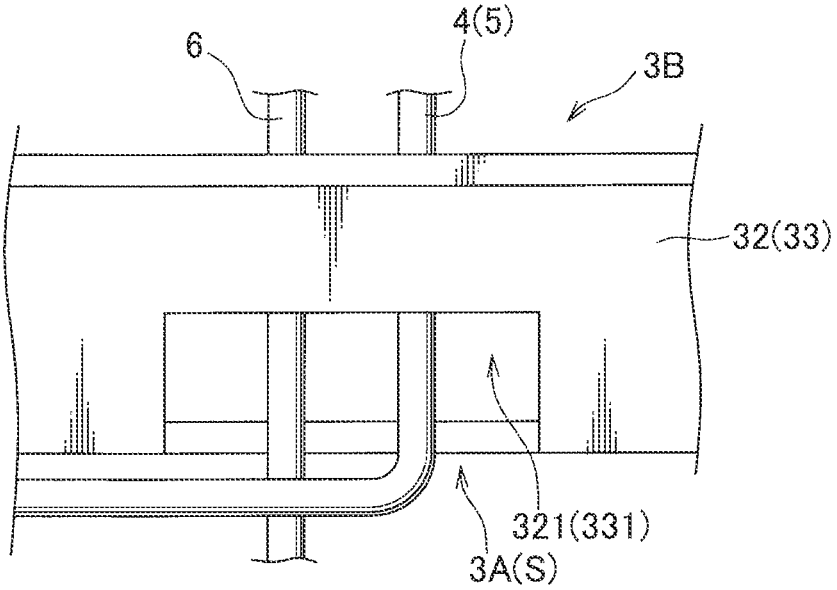
FIG. 3 is a perspective view showing a wire drawing-out structure in the winding unit.
Figure 4:
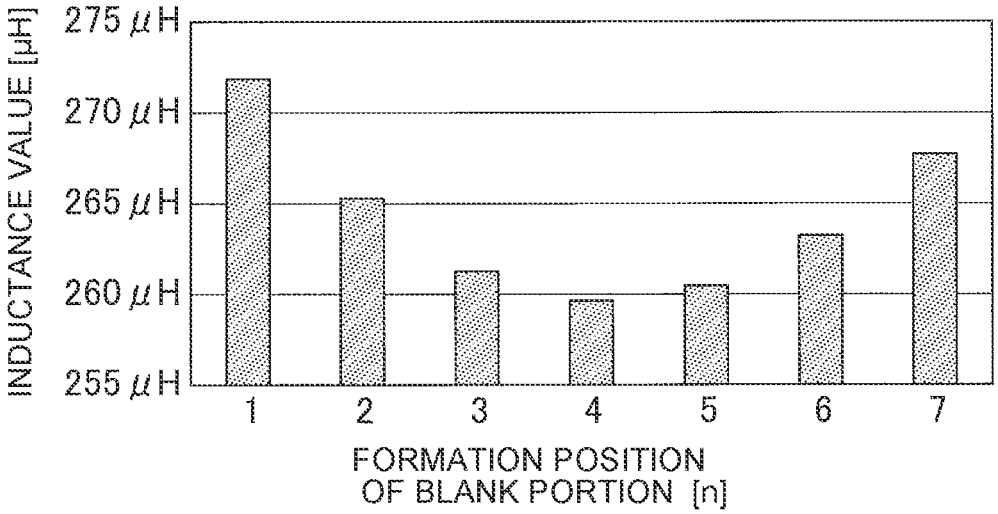
FIG. 4 is a graph illustrating an inductance value of the winding portion for a position of a blank portion in the winding unit.

Hereafter, an embodiment of the present invention will be described with reference to drawings. FIG. 1 is a perspective view showing a power supplying unit in which a winding unit is arranged. FIG. 2A is a cross sectional view taken along an X-X line of FIG. 1. FIG. 2B is a cross sectional view showing a state that a winding portion is not arranged in FIG. 2A. FIG. 3 is a perspective view showing a wire drawing-out structure in the winding unit. FIG. 4 is a graph illustrating an inductance value of the winding portion for a position of a blank portion of the winding unit.

A winding unit 1 of an embodiment in the present invention is provided in a power supplying unit 10 constituting a non-contact power supply device together with a power receiving unit not shown. As shown in FIG. 1, the winding unit 1 includes a winding portion 2 and a case as a receiving portion for receiving the winding portion 2. The power supplying unit 10 includes a power supply portion 11 as an external component arranged outside a case 3, and a capacitor 12 as a circuit component received in the case 3. The winding portion 2 and the capacitor 12 are connected by an electric wire 4, the winding portion 2 and the power supply portion 11 are connected by an electric wire 5, the power supply portion 11 and the capacitor 12 are connected by an electric wire 6, and thereby a LC circuit is formed. In the non-contact power supply device, for example, the power supplying unit is installed on the grand of a parking area, and power receiving unit is mounted on a vehicle. The power supply portion 11 having an inverter connected to a commercial power supply is used to charge a secondary battery provided in the vehicle.

As shown in FIG. 2A, the winding portion 2 is formed into a scroll-like shape (that is, a spiral shape) and constructed by a plurality of turns of coil portion 21-28 arranged in a radial direction. In an example shown in FIG. 2A, a blank portion 20 is formed between a second coil portion 22 and a third coil portion 23. The second coil portion 22 is positioned second from the inside in the radial direction, and the third coil portion 23 is positioned third from the inside in the radial direction. The winding portion 2 is connected to the capacitor 12 via the electric wire 4 in an inner side thereof, and the winding portion 2 is connected to the power supply portion 11 via the electric wire 5 in an outer side thereof.

The plurality of turns of coil portion 21-28 are formed by one continuous electric wire 100. In the embodiment of the present invention, bent portions 21A-27A are formed in positions of the same circumferential direction, and they are virtual partitions for a connection between the electric wires 4 and 5 in the winding portion 2. In the most inner coil portion 21, a bent portion 21A is formed by bending the electric wire 100 such that the electric wire 100 is wound along an outer side of an inner wall portion 32 of the case 3 described below from the connection with the electric wire 4 and a portion in which the electric wire 100 has already been wound is arranged at outer side in the radial direction when again arriving at the connection with the electric wire 4. Therefore, the coil portion 21 indicates a range from the connection with the electric wire 4 to the bent portion 21A. Also, the other coil portions 22-28 are the same as the coil portion 21.

A blank portion 20 is formed by not providing the coil portion in one of holding grooves 311-319 described hereinafter of the case 3. In other words, a gap which is equal to or larger than the radial dimension of the coil portion for one turns is formed between two coil portions 22, 23 arranged next to each other. Since the blank portion 20 is formed in the winding portion 2, the winding portion 2 is separated into an inner side portion 2A including the first and second coil portions 21, 22 from an inner side and an outer side portion 2B including the third to eighth coil portions 23-28 from the inner side in the radial direction.

The case 3 has a bottom plate portion 31, an inner wall portion 32 vertically extending from the bottom plate portion 31, and an outer wall portion 33 vertically extending from the bottom plate portion 31, and is formed in a box-shape of which one surface opens. Further, in FIG. 1, the inner wall portion 32 and the outer wall portion 33 are shown with two-dot chain lines. In the case 3, a portion arranged on the bottom plate portion 31 and between the inner wall portion 32 and the outer wall portion 33 becomes a receiving space 3A capable of receiving the winding portion 2. The coil portion 21 which is the most inner of the radial direction is located along the outer side of the inner wall portion 32, and the coil portion 28 which is the most outer of the radial direction is located along the inner side of the outer wall portion 33. Further, in the case 3, a portion arranged on the bottom plate portion 31 and surrounded by the inner wall portion 32 becomes a part arrangement portion 3B. The capacitor 12 is located on the part arrangement portion 3B. Also, a cover member may be arranged so as to an opening of the case.

On the upper surface of the bottom plate portion 31, nine holding grooves 311-319 are formed between the inner wall portion 32 and the outer wall portion 33 so as to be able to place each of one turn of the coil portion, and a projection 310 are formed between the two holding groves. The holding grooves 311-319 is formed in a shape along the outer peripheral surface of the electric wire 100 constituting the winding portion 2. In other words, in the embodiment of the present invention, the holding grooves 311-319 are formed in a semicircular cross section with respect to the electric wire 100 having a circular cross section. The coil portions 21-28 are placed on the first, second, fourth—ninth holding grooves 311, 312, 314-319, respectively. The coil portion is not placed on the third holding groove 313, and thereby the blank portion 20 is formed.

In this manner, nine holding grooves 311-319 are formed in case 3 with respect to the winding portion 2 having eight turns of the coil portion 21-28. For this reason, the receiving space 3A of the case 3 is formed so as to be capable of housing one turn of the coil portion in addition to the winding portion 2 in the radial direction.

The coil portion 22 placed on the holding groove 312 is restricted from moving to the holding groove 313 in which the blank portion 20 is formed by the projection 310 between the holding grooves 312 and 313. In the same manner, the coil portion 23 placed on the holding groove 314 is restricted from moving to the holding groove 313 in which the blank portion 20 is formed by the projection 310 between the holding grooves 313 and 314. Therefore, a movement restriction portion is constructed with the holding grooves 311-310 and the projection 310.

As shown in FIG. 3, in the inner wall portion 32, an inner wall insertion hole 321 as an inner wall passing section for connecting the receiving space 3A and the part arrangement portion 3B is formed. The electric wires 4 and 6 are inserted into the inner wall insertion hole 321, and pass therethrough.

As shown in FIG. 3, in the outer wall portion 33, an outer wall insertion hole 331 as an outer wall passing section for connecting the receiving space 3A and a space S of the outer side of the case. The electric wires 5 and 6 are inserted into the outer wall insertion hole 331, and pass therethrough.

In the winding unit 1 of the embodiment in the present invention as described in the above, the blank portion 20 are formed between the second coil portion 22 and the third coil portion 23 from the inner side in the winding portion 2, but it is not limited thereto. For example, it is possible to form the blank portion by not placing any one of nine holding grooves 311-319 when the winding portion 2 including the eight coil portions (eight turns) is housed in the case 3. More specifically, the blank portion may be formed between any of the two coil portions next to each other in the winding portion 2, and may be formed between the most inner coil portion 21 in the radial direction and the inner wall portion 32. In addition, the blank portion may be formed between the most outer coil portion 28 in the radial direction and the outer wall portion 33.

In this manner, a formation position of the blank portion is changed. For this reason, an inductance value of the winding portion 2 is changed. Here, a dependency of the inductance value of the winding portion 2 for the formation position of the blank portion is shown in FIG. 4. The formation position n of a vertical axis in the graph of FIG. 4 means that the blank portion is formed on the Nth holding groove positioned from the outer side in the radial direction. For example, when n is equal to 1 (n=1), the blank portion is formed on the most outer holding groove 319. When n is equal to 2 (n=2), the blank portion is formed on the second holding groove positioned on the second from the outer side.

As shown in FIG. 4, the inductance value becomes small as the formation position of the blank portion is closer toward the inner side from the most outer (that is, as n becomes large). When n is equal to 4 (n=4), the inductance value becomes the minimum value. Further, the inductance value becomes large as the formation position of the blank portion is further closer toward the inner side (that is, as n becomes large). In other words, when the blank portion is formed near the center of the winding portion 2 in the radial direction, the inductance value becomes small. In this way, the inductance value of the winding portion 2 is changed depending on the formation position of the blank portion.

Herein, a process and method for manufacturing the winding unit 1 will be explained. First, the design value of the resonance frequency is determined in response to various conditions of the non-contact power supply device (for example, the distance between the power supplying unit and the power receiving unit, and the characteristics of the inverter of the power supply portion 11 etc.). Next, the capacitance of the capacitor 12 is determined so as to obtain the actual measured value of the capacitance. Based on such the actual measured value, the inductance value of the winding portion 2 which is required for the response frequency to be the above design value can be obtained. The formation position n of the blank portion is determined based on the relationship between the inductance value obtained experimentally in advance as shown in FIG. 4 and the formation position such that the winding portion 2 has such inductance value.

The winding portion 2 is formed by winding the electric wire 10 such that the blank portion is formed on the formation position n obtained as mentioned above. At this time, the electric wire 10 may be wound along the holding groove, and the winding portion 2 may be housed in the case 3 such that each of the coil portions is placed on the holding groove after forming the winding portion 2 independently of the case 3. The winding unit 1 as manufactured such that and the capacitor 12 are connected by the electric wires 4-6, and thereby the power supplying unit 10 is constructed.

According to the embodiment of the present invention as described above, there are the following effects. More specifically, since the case 3 has the receiving space 3A capable of receiving at least one turn of the coil portion in addition to the winding portion 2, the blank portion can be formed at an appropriate position when manufacturing the winding unit 1. Further, it is not necessary to change the number of turns of the winding portion 2 (the number of coil portion), and the inductance value of the winding portion 2 can be adjusted with simply construction.

In this way, a resonance frequency of the non-contact power supply device can be controlled by adjusting the inductance value of the winding portion 2. For this reason, when design of the non-contact power supply device is changed and a design value is changed, it is possible to communalize the case 3. Further, when variation occurs in the capacitance of the capacitor 12, the inductance value can be adjusted such that the resonance frequency is the design value. Furthermore, costs can be reduced by using the capacitor having large variations in the capacitance.

Further, when the position relationship (such as the distance between the coils) between the winding portion of the power supplying unit and the winding portion of the power receiving unit is changed by changing vehicle type and location on which the power receiving unit of the non-contact power supply device is mounted, a state of magnetic coupling between those winding portions is changed, and power transmission characteristics are changed. At this time, in the embodiment of the present invention, since the inductance value of the winding portion 2 can be adjusted with simply construction as mentioned above, a desired power transmission characteristic can be easily obtained.

Furthermore, the movement restriction portion includes the holding grooves 311-319 and the projection 310, and movement of the coil part to the blank part is regulated. Thereby, unintentionally changes of the inductance value of the winding portion 2 can be controlled.

Moreover, it is not necessary to change the number of turn of the winding portion 2 so as to adjust the inductance value as described above. Therefore, a position putting out the electric wire 4 from the winding portion 2 inward in the radial direction can be maintained constant, and the electric wire 4 can be easily passed through the inner wall insertion hole 321. Furthermore, there is no need to change the orientation and arrangement of the capacitor 12 according to the number of turns. Also, a position putting out the electric wire 5 from the winding portion 2 outward in the radial direction, and the electric wire 5 can easily pass through the outer wall insertion hole 331.

It should be noted that the present invention is not limited to the above embodiment. The present invention includes any other structures and the like that can achieve the object of the present invention, and also includes the following modifications and the like.

Figure 5:
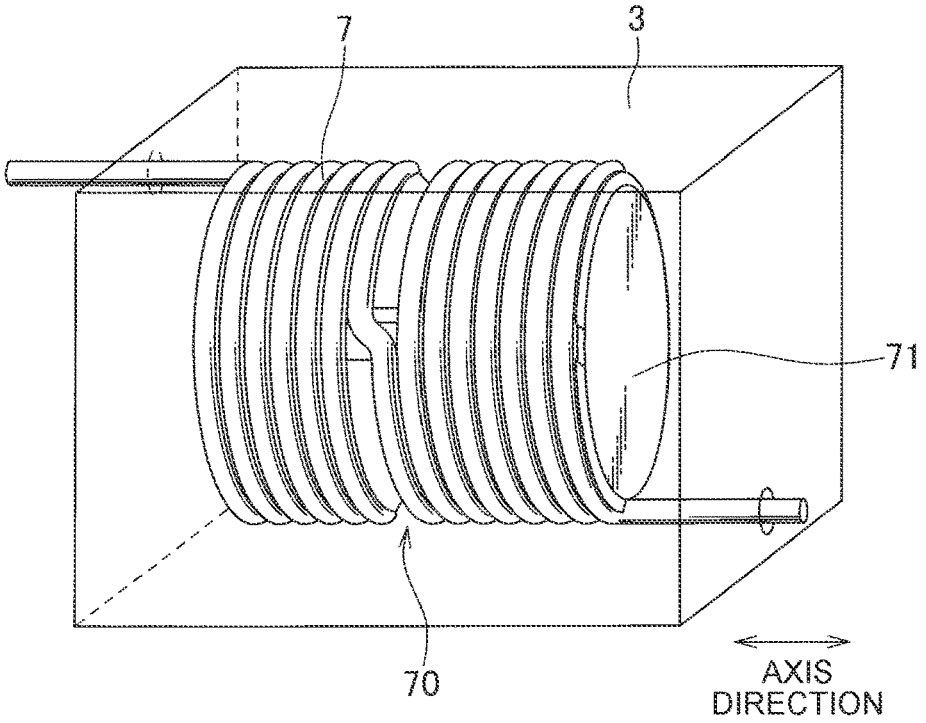
FIG. 5 is a perspective view showing the winding unit according to one modified example of the present invention.

For example, while the winding portion 2 is formed by a plurality of turns of coil portions 21-28 arranged in the radial direction as an arrangement direction in the above embodiment, as shown in FIG. 5, the winding portion 7 may be formed by a plurality of coil portions arranged in the axis direction as an arrangement direction. In the illustrated example, the blank portion 70 is formed between the two coil portions next to each other in the axis direction, but it is not limited thereto. The blank portion may be formed between the coil portion of the end portion in the axis direction and a wall portion of the case 3 opposed to the coil portion of the end portion in the axis direction. Also, in the winding 7, the electric wire is wound around a bobbin 71. The bobbin 71 has a function for fixing the electric wire, and restricts the coil portion from moving toward the blank portion 70.

Further, in the above embodiment, the movement restriction portion is constructed by the holding grooves 311-319 and the projection 310, but it is not limited thereto. The movement restriction portion may be any one capable of restricting the coil portion from moving toward the blank portion. For example, the top surface of the bottom plate portion 31 may flatly formed, a plurality of projections may be stood, and a space between the projections may become the holding groove. In other words, the holding groove may not have a shape along the outer circumferential surface of the electric wire.

Figure 6A:
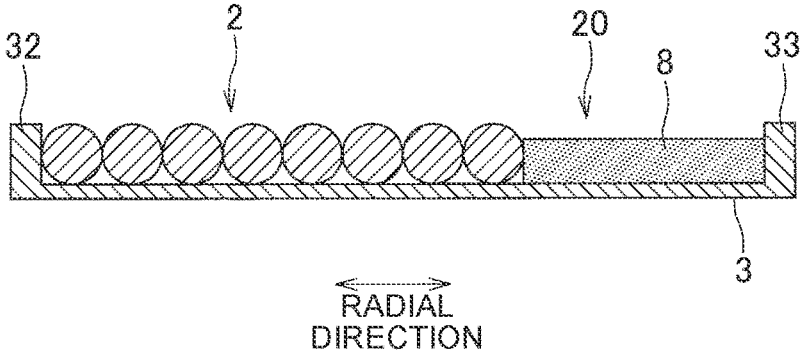
FIGS. 6A and 6B are cross sectional views showing a main part of the winding unit according to the other modified example of the present invention.
Figure 6B:
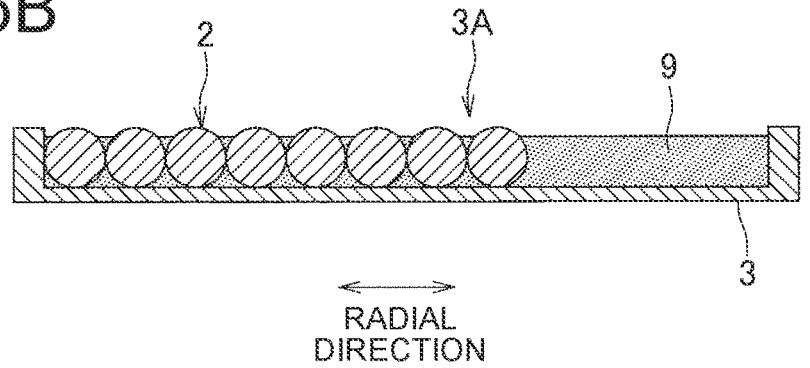

Further, as shown in FIG. 6A, a holding portion 8 for pressing the coil portion arranged in the radial direction of the winding portion 2 from the radial direction may be used as the movement restriction portion. In the example shown in FIG. 6A, the blank portion is formed between the most outer coil portion in the radial direction and the outer wall portion 33. The coil portion is sandwiched between the holding portion 8 and the inner wall portion 32, and thereby the movement of the coil portion to the blank portion 20 is restricted. Furthermore, when the blank portion is formed between the two coil portions, the holding portion is provided on the blank portion. The coil portion is sandwiched between a pair of holding portions, and thereby the movement of the coil portion to the blank portion may be restricted. Moreover, as shown in FIG. 6B, in a state that the winding portion 2 is housed in the case 3, a resin member 9 is potted in the receiving space 3A. The movement of the coil portion in the winding portion 2 is restricted by the resin member 9. For this reason, the resin member 9 may be used as the movement restriction portion. Further, when the winding portion 2 is hardly deformed and the coil portion is difficult to sufficiently move to the blank portion, the movement restriction portion may be omitted.

Further, in the above embodiment, while the inner wall insertion hole 321 as the inner wall passing section is formed in the inner wall portion 32, and the outer wall insertion hole 331 as the outer wall passing section is formed in the outer wall portion 33, the inner wall passing section and the outer wall passing section may any one in which the electric wire can pass through. For example, the inner wall passing section and the outer wall passing section may be formed in a notched shape. Furthermore, when the electric wire is sterically pull out from the winding portion 2 and is wired over the inner wall and the outer wall, the inner wall passing portion and the outer wall passing portion may not be formed. In addition, when the electric wire does not need to pass through the inner wall passing section and the outer wall passing section may be not formed.

Figure 7A:
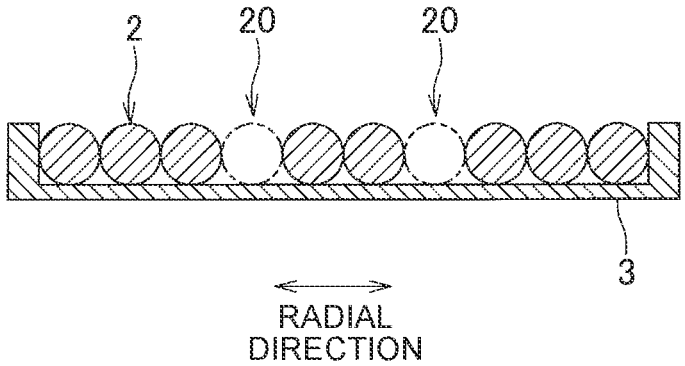
FIGS. 7A and 7B are cross sectional views showing a main part of the winding unit according to the other modified example of the present invention.
Figure 7B:
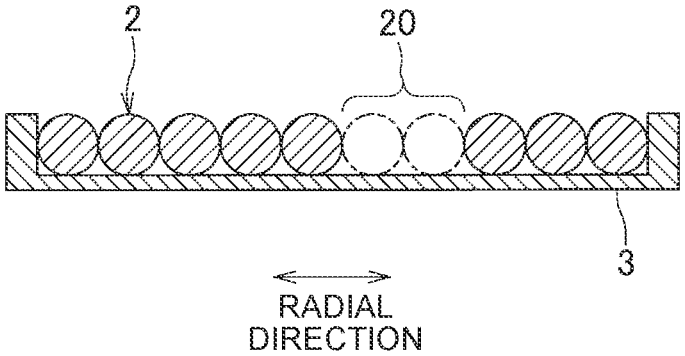

Further, in the above embodiment, while the case has the receiving space 3A capable of housing one turn of the coil portion in addition to the winding portion 2 in the radial direction, the receiving space 3A may be capable of housing more than the two turns of the coil portion in addition to the winding portion 2. At this time, as shown in FIG. 7A, the receiving space 3A can house the two turns of the coil portion in the addition to the winding portion 2, and the blank portion 20 may be formed in two places. Furthermore, as shown in FIG. 7B, the blank portion having the radial dimension of the two turns of the coil portion may be formed.

Figure 8:
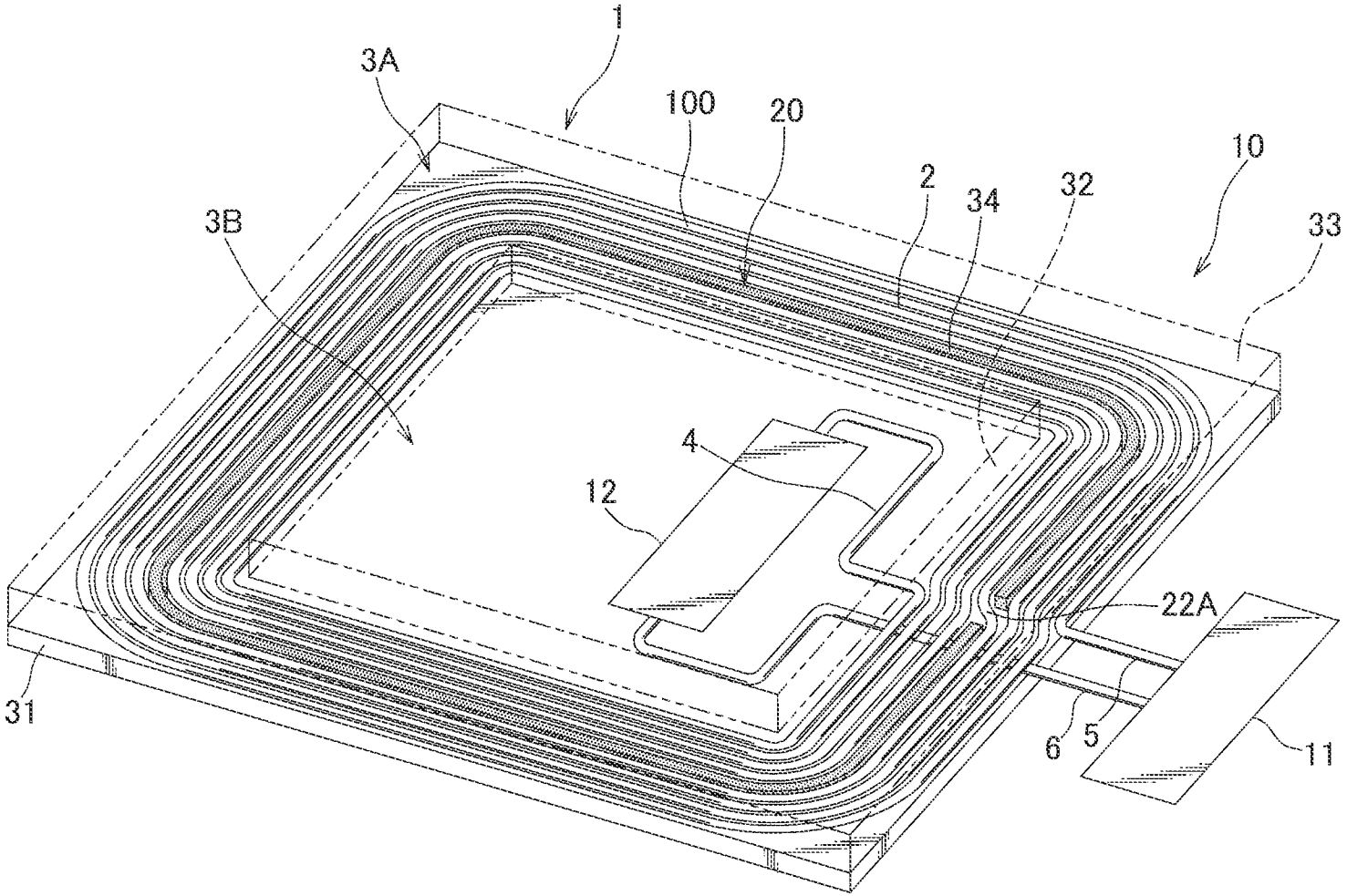
FIG. 8 is a perspective view showing the power supplying unit in which the winding unit according to the other modified example of the present invention is arranged.
Figure 9A:
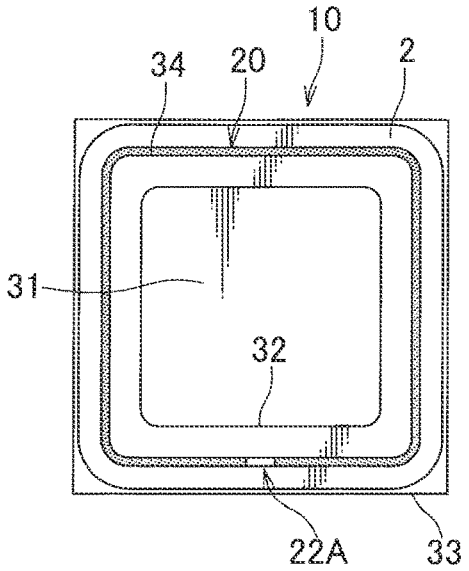
FIGS. 9A and 9B are plane views showing a main part of the winding unit.
Figure 9B:
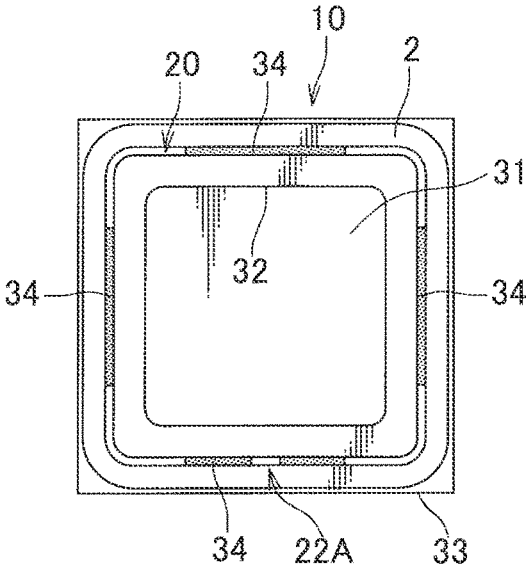

Moreover, in the above embodiment, while any one of the holding grooves 311-319 formed on the top surface of the bottom plate portion 31 becomes the blank portion, and the projection 31 is located in the blank portion, a standing wall may be provided on the blank portion. In other words, as shown in FIG. 8, the standing wall 34 may be stood from the bottom plate portion 31 on which the winding portion 2 is mounted. At this time, as shown in FIG. 9A, the standing wall 34 is arranged around the entire circumference of the blank portion 20 except the bent portion 22A between the coil portions, and is formed in a C-shaped. Furthermore, as shown in FIG. 9B, a plurality of the standing walls 34 spaced apart in the radial direction may be provided.

By providing the standing wall 34 in this manner, deformation such that the bottom plate portion 31 is bent or twisted hardly occurs even if an external force is applied to the case 3. Therefore, the strength of the case 3 can be improved. Since the standing wall 34 is provided on the blank portion 20, it is possible to suppress increase in the overall size of the winding unit due to providing the standing wall 34.

Figure 10A:
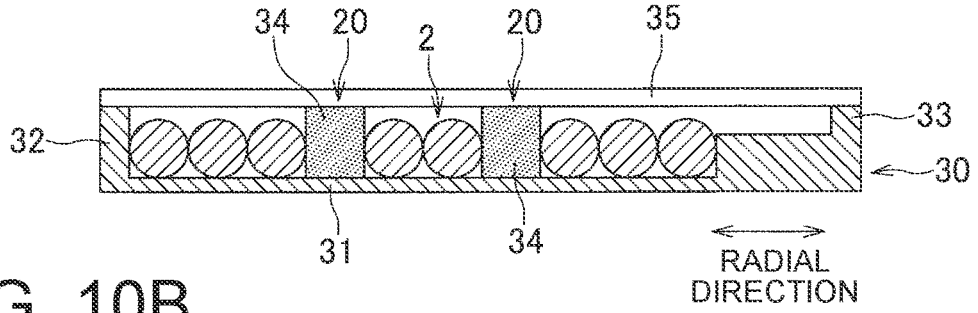
FIGS. 10A and 10B are cross sectional views showing a main part of the winding unit according to the other modified example of the present invention.

As shown in FIG. 10A, the standing wall 34 may have a height dimension (projection dimension) larger than the diameter of the electric wire constructing the winding portion 2, and may be abut on a protective cover 35. According to such structure, even if the protective cover 35 has low strength and is simple formed, deformation hardly occurs, and addition of a load to the winding portion 2 can be prevented. Further, when strength of the protective cover 35 is enough, the standing wall 34 may be lower than the electric wire. The standing wall 34 may have suitable height which can increase strength of the case 3.

Furthermore, as shown in FIG. 10A, the standing wall 34 may be arranged such that all of the blank portion 20 is filled in the radial direction, and may abut on the electric wire constructing the winding portion 2. In other words, the standing wall 34 may function as the movement restriction portion for preventing the coil portion from moving to the blank portion. In addition, as shown in FIG. 10B, the standing wall 34 may not abut on the electric wire constructing the winding portion 2, and may not function as the movement restriction portion.

Figure 10B:
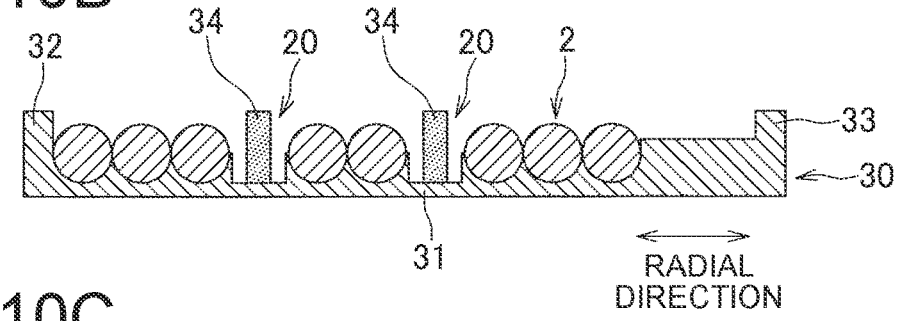
Figure 10C:
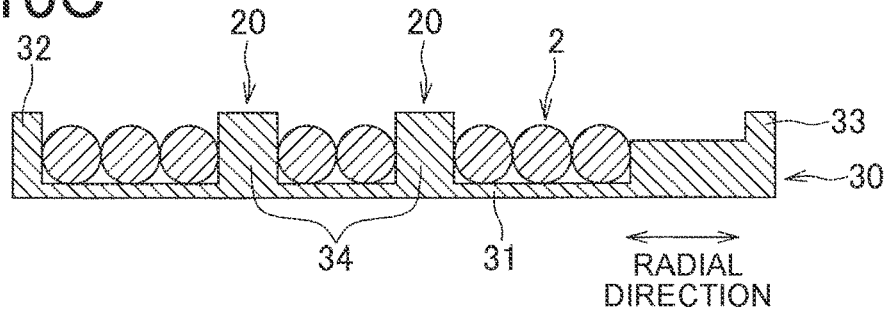

As shown in FIGS. 10A and 10B, the standing wall 34 may be formed separately from the bottom plate portion 31. Further, as shown in FIG. 10C, the standing wall 34 may be integrally formed together with the bottom plate portion 31.

In the above embodiment, while the non-contact power supply device having the winding unit 1 is provided on a vehicle, for example the winding unit 1 may be arranged on the non-contact power supply device for charging terminal of communication device.

In addition, while the best structures, methods, and the like for carrying out the present invention are disclosed in the above description, the present invention is not limited to the above description. That is, though the present invention is particularly shown in the drawings and described, chiefly regarding specific embodiments, the skilled person could add various modifications to shapes, materials, volumes, and other detailed structural matters in the above-described embodiments without departing from the scope of a technical idea and an object of the present invention. Therefore, since the above description which limits shapes, materials, and the like as disclosed above is made as an example for easier understanding of the present invention, and does not limit the present invention, description of members with names which remove a part or all of limitations on those shapes, materials, and the like is included in the present invention.

REFERENCE SINGS LIST

1 winding unit
2 winding portion
3 case (receiving portion)
4, 5 electric wire
11 power supply portion (external component)
12 capacitor (circuit component)
21-28 coil portion
20 blank portion
31 bottom plate portion
32 inner wall portion
33 outer wall portion
34 standing wall
3A receiving space
3B part arrangement portion
311-319 holding groove
310 projection
321 inner wall insertion hole (inner wall passing section)
331 outer wall insertion hole (outer wall passing section)

What is claimed is:

1. A winding unit arranged on a power supplying unit or a power receiving unit of a non-contact power supply device comprising:

a winding portion for transmitting/receiving power to be constructed by a plurality of turns of coil portion arranged in a predetermined arrangement direction; and a receiving portion having a receiving space housing at least one turn of the coil portion in addition to the winding portion in the arrangement direction, wherein a blank portion is formed between the two coil portions next to each other in the winding portion or between the coil portion positioned on an end portion in the arrangement direction in the winding portion and the receiving portion, the blank portion having a gap with a dimension of at least one turn of the coil portion in the arrangement direction, wherein the blank portion is formed between the two coil portions next to each other, and the winding portion includes a bent portion that extends from each the two coils next to each other, and the bent portion crosses the gap.

2. The winding unit according to claim 1, wherein a movement restriction portion is provided in the receiving portion to restrict a movement of the coil portion constructing the winding portion to the blank portion.

3. The winding unit according to claim 2, wherein the movement restriction portion includes a pair of holding grooves placed on the coil portion and a projection formed between the holding grooves.

4. The winding unit according to claim 1, wherein the winding portion is formed such that the coil portion is aligned in a radial direction as the arrangement direction, the receiving portion includes an inner wall portion along an inner side of the winding portion in the radial direction, and a part arrangement portion surrounded by the inner wall and the part arrangement portion is configured to receive a circuit component connected to the winding portion, and an inner wall passing section through which an electric wire for connecting the winding portion and the circuit component passes is formed in the inner wall portion.

5. The winding unit according to claim 1, wherein the winding portion is formed such that the coil portion is aligned in a radial direction as the arrangement direction, the receiving portion has an outer wall portion along an outer side of the winding portion in the radial direction, and an outer wall passing section through which an electric wire for connecting the winding portion and external component passes is formed in the outer wall portion.

6. The winding unit according to claim 1, wherein the winding portion is formed such that the coil portion is aligned in a radial direction as the arrangement direction, and the receiving portion has a bottom plate portion on which the winding portion is placed, and a standing wall standing from the bottom plate portion and located on the blank portion.

7. The winding unit according to claim 2, wherein the winding portion is formed such that the coil portion is aligned in a radial direction as the arrangement direction, the receiving portion includes an inner wall portion along an inner side of the winding portion in the radial direction, and a part arrangement portion surrounded by the inner wall and the part arrangement portion is configured to receive a circuit component connected to the winding portion, and an inner wall passing section through which an electric wire for connecting the winding portion and the circuit component passes is formed in the inner wall portion.

8. The winding unit according to claim 3, wherein the winding portion is formed such that the coil portion is aligned in a radial direction as the arrangement direction, the receiving portion includes an inner wall portion along an inner side of the winding portion in the radial direction, and a part arrangement portion surrounded by the inner wall and the part arrangement portion is configured to receive a circuit component connected to the winding portion, and an inner wall passing section through which an electric wire for connecting the winding portion and the circuit component passes is formed in the inner wall portion.

9. The winding unit according to claim 2, wherein the winding portion is formed such that the coil portion is aligned in a radial direction as the arrangement direction, the receiving portion has an outer wall portion along an outer side of the winding portion in the radial direction, and an outer wall passing section through which an electric wire for connecting the winding portion and external component passes is formed in the outer wall portion.

10. The winding unit according to claim 3, wherein the winding portion is formed such that the coil portion is aligned in a radial direction as the arrangement direction, the receiving portion has an outer wall portion along an outer side of the winding portion in the radial direction, and an outer wall passing section through which an electric wire for connecting the winding portion and external component passes is formed in the outer wall portion.

11. The winding unit according to claim 4, wherein the winding portion is formed such that the coil portion is aligned in a radial direction as the arrangement direction, the receiving portion has an outer wall portion along an outer side of the winding portion in the radial direction, and an outer wall passing section through which an electric wire for connecting the winding portion and external component passes is formed in the outer wall portion.

12. The winding unit according to claim 2, wherein the winding portion is formed such that the coil portion is aligned in a radial direction as the arrangement direction, and the receiving portion has a bottom plate portion on which the winding portion is placed, and a standing wall standing from the bottom plate portion and located on the blank portion.

13. The winding unit according to claim 3, wherein the winding portion is formed such that the coil portion is aligned in a radial direction as the arrangement direction, and the receiving portion has a bottom plate portion on which the winding portion is placed, and a standing wall standing from the bottom plate portion and located on the blank portion.

14. The winding unit according to claim 4, wherein the winding portion is formed such that the coil portion is aligned in a radial direction as the arrangement direction, and the receiving portion has a bottom plate portion on which the winding portion is placed, and a standing wall standing from the bottom plate portion and located on the blank portion.

15. The winding unit according to claim 5, wherein the winding portion is formed such that the coil portion is aligned in a radial direction as the arrangement direction, and the receiving portion has a bottom plate portion on which the winding portion is placed, and a standing wall standing from the bottom plate portion and located on the blank portion.

16. The winding unit according to claim 1, wherein the receiving portion includes a plurality of holding grooves, and the blank portion extends along at least one of the holding grooves.

17. The winding unit according to claim 1, wherein the receiving portion includes a plurality of holding grooves having a first number of grooves, the plurality of turns of coil portion includes a second number of turns that is less than the first number of grooves.

* * * * *